US007311132B2

(12) United States Patent
Corey et al.

(10) Patent No.: US 7,311,132 B2
(45) Date of Patent: Dec. 25, 2007

(54) SELF-EQUALIZING CORDED WINDOW COVERING AND BREAKAWAY COUPLING MEMBER FOR SAME

(75) Inventors: John A. Corey, Melrose, NY (US); Richard D. Watkins, Lake Luzerne, NY (US)

(73) Assignee: Comfortex Corporation, Watervliet, NY (US)

( * ) Notice: Subject to any disclaimer, the term of this patent is extended or adjusted under 35 U.S.C. 154(b) by 345 days.

(21) Appl. No.: 11/033,251

(22) Filed: Jan. 11, 2005

(65) Prior Publication Data

US 2005/0199353 A1 Sep. 15, 2005

Related U.S. Application Data

(60) Provisional application No. 60/537,370, filed on Jan. 17, 2004.

(51) Int. Cl.
*E06B 9/30* (2006.01)

(52) U.S. Cl. ..... 160/168.1 R; 160/173 R; 160/178.1 R

(58) Field of Classification Search ..... 160/168.1 R, 160/173 R, 178.1 R, 84.01, 84.04, 178.2; 24/115 F, 129 B, 129 D
See application file for complete search history.

(56) References Cited

U.S. PATENT DOCUMENTS 2,733,527 A * 2/1956 Flood ..... 40/663
2,809,409 A * 10/1957 Rosenbaum ..... 24/129 B
3,280,890 A * 10/1966 Preziosi ..... 160/168.1 R
4,441,540 A * 4/1984 Tsuhako ..... 160/168.1 R
4,639,977 A * 2/1987 Howard ..... 24/16 R
4,673,018 A * 6/1987 Judkins ..... 160/84.06
4,739,816 A * 4/1988 Dodich et al. ..... 160/168.1 R
4,909,298 A * 3/1990 Langhart et al. ..... 160/178.1 R
5,628,091 A * 5/1997 Mueller ..... 24/3.2
5,996,204 A * 12/1999 Norwood ..... 29/450
6,550,522 B1 * 4/2003 Lennon et al. ..... 160/168.1 R

* cited by examiner

*Primary Examiner*—Blair M. Johnson
(74) *Attorney, Agent, or Firm*—Rader, Fishman & Grauer PLLC

(57) ABSTRACT

A cord-operated window covering is provided with means for equalizing the individual lift cord lengths to maintain a horizontal and level bottom rail, while avoiding the choking danger to small children presented by exposed cord loops that can become entangled with the child. A break-away coupling of the exposed cord ends is provided in the form of a shear-loaded, separable joint that is strong when subjected to shear-type forces in normal use, but which is weak when loaded in peel or tension perpendicular to the joint, as would occur in a potentially dangerous child-entangled situation. The joint is formed by surface-modifying products applied to the opposed abutting surfaces of the individual cordlock members. Also disclosed is an embodiment that utilizes a continuous lift cord loop that is frictionally gripped by a gripper member secured to the shade. The gripper member temporarily permits the cord to slip through the gripper if the operator applies sufficient manual downward force on the higher end of a bottom rail that has lost its desired horizontal or level orientation.

7 Claims, 7 Drawing Sheets

SELF-EQUALIZING CORDED WINDOW COVERING AND BREAKAWAY COUPLING MEMBER FOR SAME

FIELD OF THE INVENTION

The present invention relates to devices for equalizing cords in multi-cord window coverings and the like and, more particularly, to devices that can be adjusted after installation to compensate for wear, stretch, non-level window frames, or errors in manufacture and, optionally, to provide a safety benefit by low-force separation in the event of bodily entanglement.

BACKGROUND OF THE INVENTION

Many types of window coverings or treatments such as venetian blinds, cellular or pleated shades, and variants of these (here represented without restriction merely by "shades"), utilize multiple internal lift cords (see, e.g., FIG. 1). These lift cords 1 are typically anchored to a movable lower or "bottom" rail 2 and run upward through a shade or blind into a relatively-fixed top or "head" rail 3, and then through a locking mechanism 4 and out. More than one such cord is required to provide uniform and level support to the shade, and wide shades may have many such cords. Convenient operation of the shade demands that a single device 5 be grasped by the operator, not a multitude of cords, so the exited cords are conventionally joined to a single extension cord 6, at a common coupling 7. This coupling is often called an equalizer, because the multiple cords are knotted to the coupling during manufacture, giving the manufacturer an opportunity to adjust the effective length of each cord (by knot placement or otherwise), thereby making all the cords share the load. Notably, the task of reliably ensuring that all the cords are in fact equally loaded (and the shade thereby level-hanging once installed) has proven to be difficult in practice and is a significant cause of manufacturing cost, customer complaint and returns for repair.

In recent years, cases of accidental death and injury have been documented in which a person, typically a baby or small child, perhaps in playing with such multiple cords, becomes entangled and chokes or asphyxiates when the cords constrict their airways. Several novel designs for the cord coupling have been presented with the object of providing a passive means to prevent such disasters, without loss of function or aesthetic appeal in the shade or its actuator cords and without added costs. Such couplings may achieve this end by providing multiple elements, each joined to one of the multiple cords, held together by a spring force or mechanical engagements (like pin-and-hole pairs) that transmit the cord tension of normal operation, but readily separate when anything becomes caught among the cords, thereby releasing the loop that might cause injury. However, it is relatively difficult for the fabricators of shades using such couplings to efficiently achieve equalization of the multiple cords during manufacture, because of the difficulty of individually terminating each of the several cords in the several parts of the coupling at precisely the same cord lengths.

Consequently, there exists a need for a safety-separating cord collator/equalizer that exhibits a simple, post-assembly or post-installation way to equalize the cords of a multi-cord shade so that cord terminations can be made just once, without regard for their precise lengths at termination. By this design, the labor cost for each shade is reduced and the satisfaction of the user is increased.

SUMMARY OF THE INVENTION

The present invention provides convenient means for adjusting the individual lift cord lengths for cord-controlled window covering, while avoiding the dangers of strong loops that may entangle and choke a child. In one embodiment, the exposed individual cord ends each terminate in shear-loaded, separable joints between cordlock members. These members have a surface modifier on opposing abutting surfaces, which modifiers readily separate in peel or tension perpendicular to their surfaces, as would occur if a child became entangled in the cords, but grip each other strongly in shear conditions that arise during normal raising and lowering of the window covering. Another feature utilizes a continuous lift cord loop that is frictionally gripped by a gripper member secured to the shade. The gripper member maintains an existing positional relationship between the cord loop and the window covering's bottom rail during normal raising and lowering of the window covering, but temporarily permits the cord to slip through the gripper if the operator applies sufficient manual downward force on the higher end of a bottom rail that has lost its desired horizontal or level orientation.

BRIEF DESCRIPTION OF THE DRAWINGS

Embodiments of the invention will now be described, by way of example, with reference to the accompanying drawings, wherein.

DETAILED DESCRIPTION OF THE INVENTION

Figure 1:
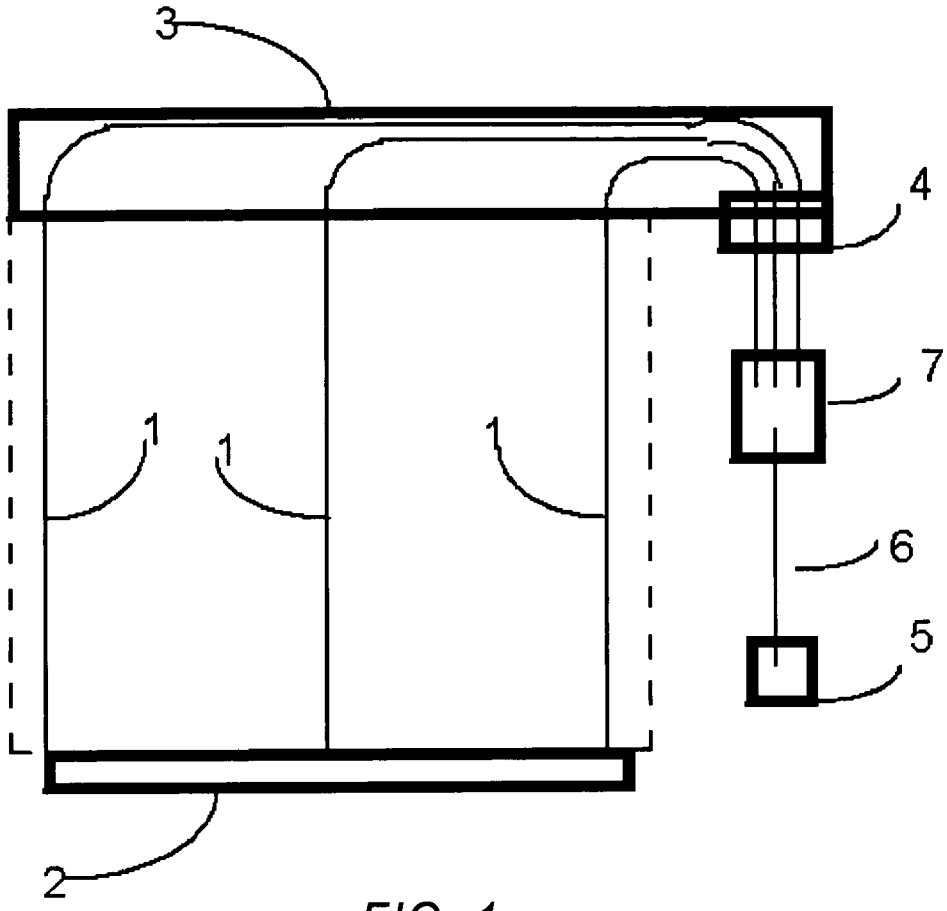
FIG. 1 (PRIOR ART)
FIG. 1 is simplified illustration of a prior art multi-cord window covering.
Figure 2:
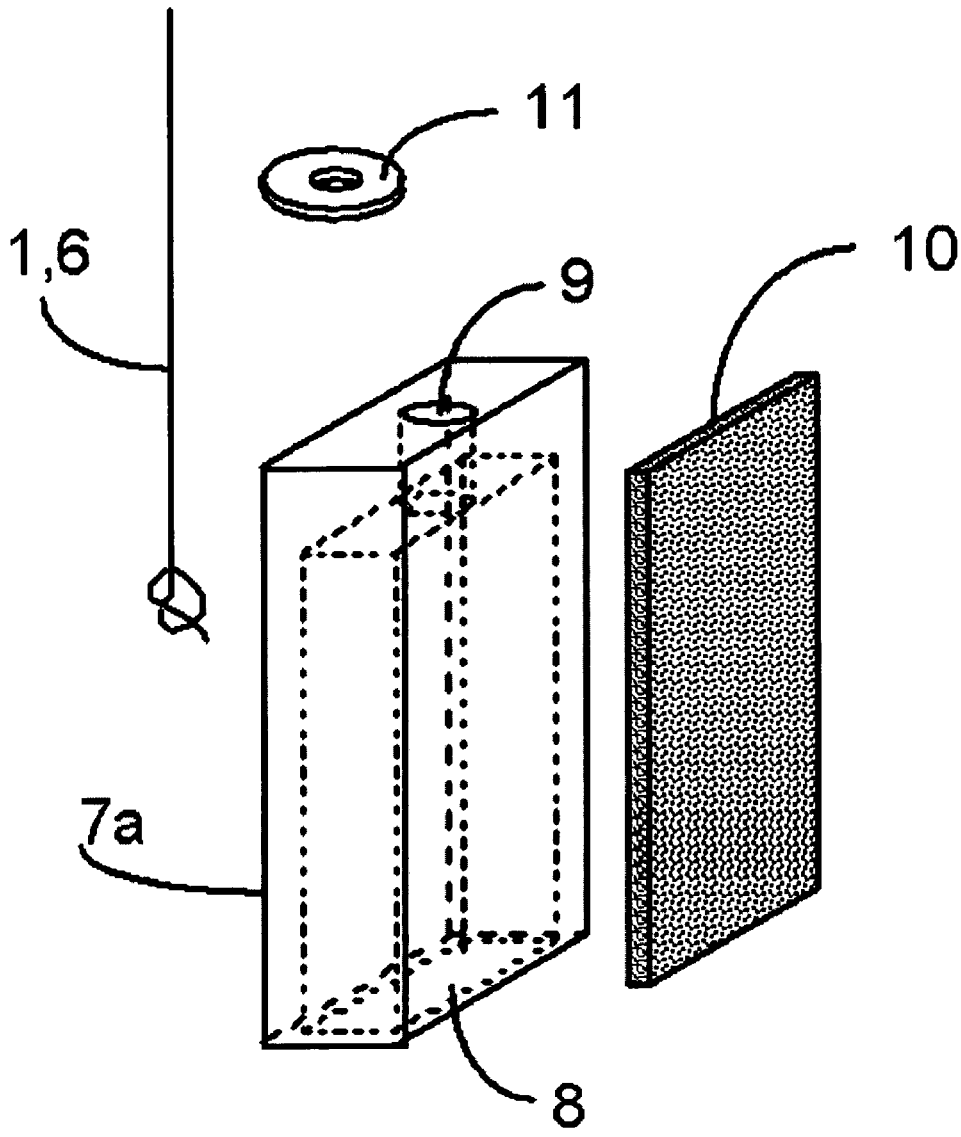
FIG. 2 is an exploded perspective view of a cordlock member according to an embodiment of the present invention.

Referring to FIG. 2 of the drawings, an exploded perspective view of a coupling member for use in a coupling assembly or "equalizer" is shown. In an embodiment of the invention, the coupling member includes a cordlock member 7*a*, with an internal cavity 8 and an orifice 9. The coupling member also includes a shear-gripping surface modifier 10, a lift cord 1 or a pull cord 6 and, optionally, a cord retainer 11. The surface modifier 10, which grips strongly in shear but easily separates in peel or tension perpendicular to the surface of cordlock member 7*a*, is applied to one or two opposite faces of cordlock member 7*a*. Surface modifiers for use on cordlock member 7*a* include, for example, Velcro™ and Duo-Lock™ (3M Corporation), both of which are of the multi-element interlocking type, are available in ribbons or pre-cut patches, and may include pressure-sensitive adhesive backings to attach to cordlock member 7*a*. Alternately, surface modifier 10 may include a brittle glue with low peel strength (but high shear strength), an integral interlocking texturing of cordlock member 7*a* itself, a peelable tack surface (like the tack surface used in Post-It™ notes (also from 3M Corporation)), or combinations thereof. Surface modifiers that use interlocking surfaces are preferred because of their reusability, which allows for repositioning and relative adjustment of the cords 1, 6 to equalize their loads. Among the interlocking surface style surface modifiers, Duo-Lock™ is preferred further because Velcro™ includes pairs of two distinct surface types; whereas Duo-Lock is hermaphroditic, allowing all surface modifiers 10 to be identical.

Figure 3:
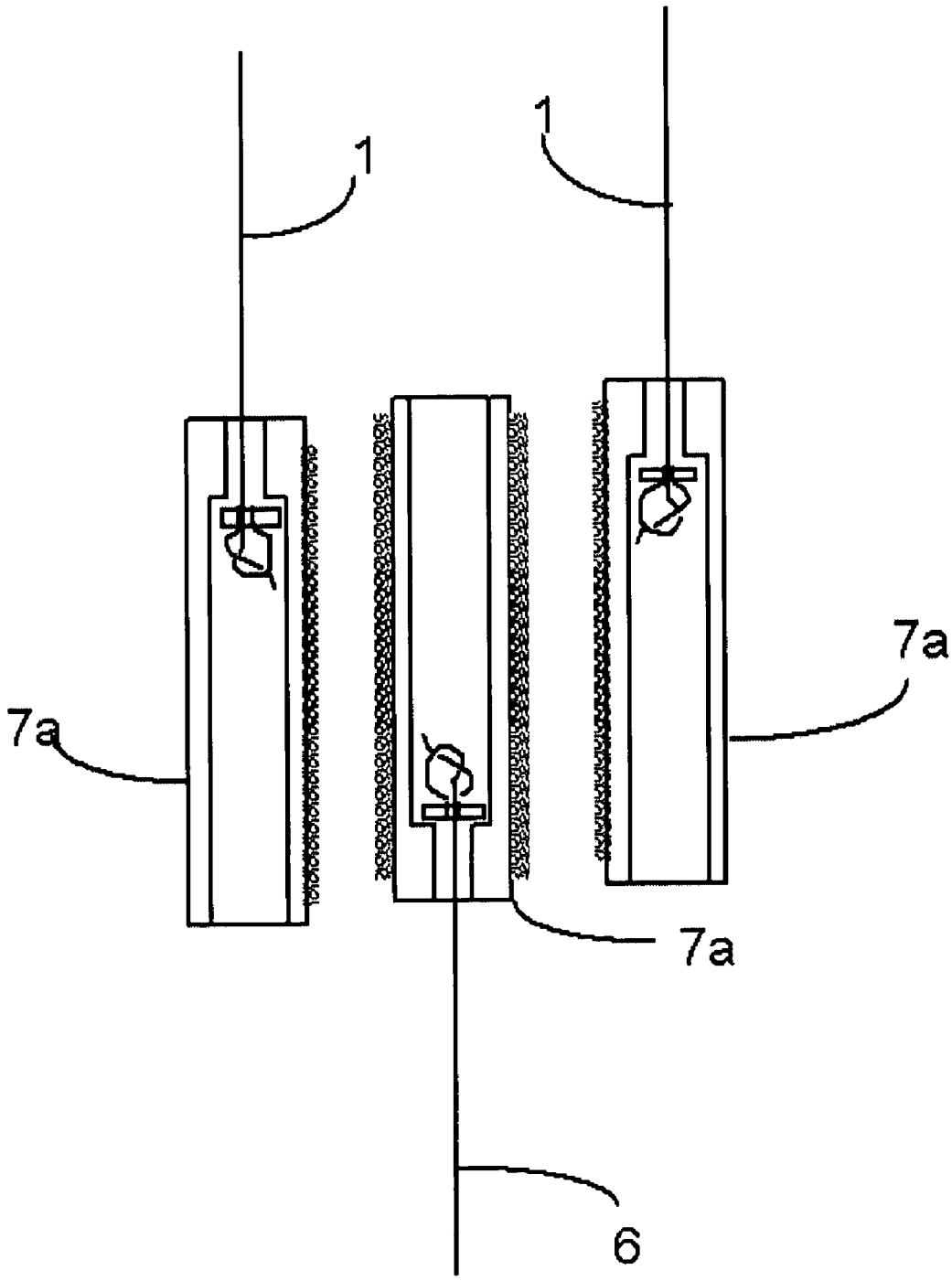
FIG. 3 is a side elevation view of a coupling assembly according to an embodiment of the invention.

Referring to FIG. 3, a coupling assembly 7 is shown that attaches two lift cords 1 and a single pull cord 6. During assembly, each of cords 1, 6 is passed into a cordlock member 7*a* through orifice 9, optionally through retainer 11, and then knotted or otherwise secure to cordlock member 7*a*. The positions of each outer cordlock member 7*a* may be different (vertically) to easily accommodate variations in the lengths of the cords 1. While the coupling assembly is shown in FIG. 3 as "exploded", the surface modifiers 10 are actually engaged in use. Note also that, in the embodiment shown in FIG. 3, cordlock member 7*a* on pullcord 6 carries surface modifiers 10 on each face, while outer cordlock members 7*a* on lift cords 1 do not require modifiers on their outer faces.

Figure 4:
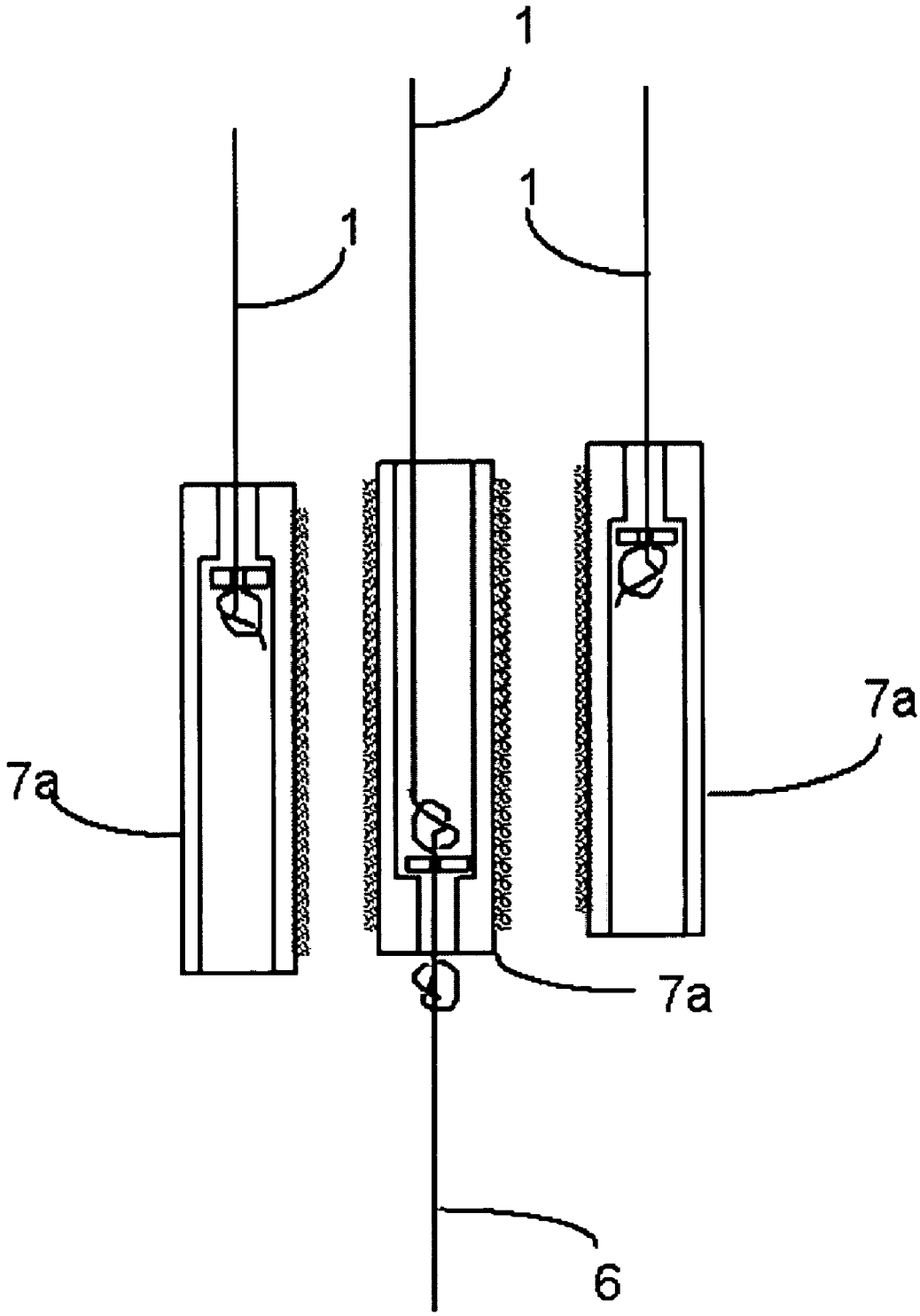
FIG. 4 is a side elevation view of a coupling assembly according to another embodiment of the invention.
Figure 5:
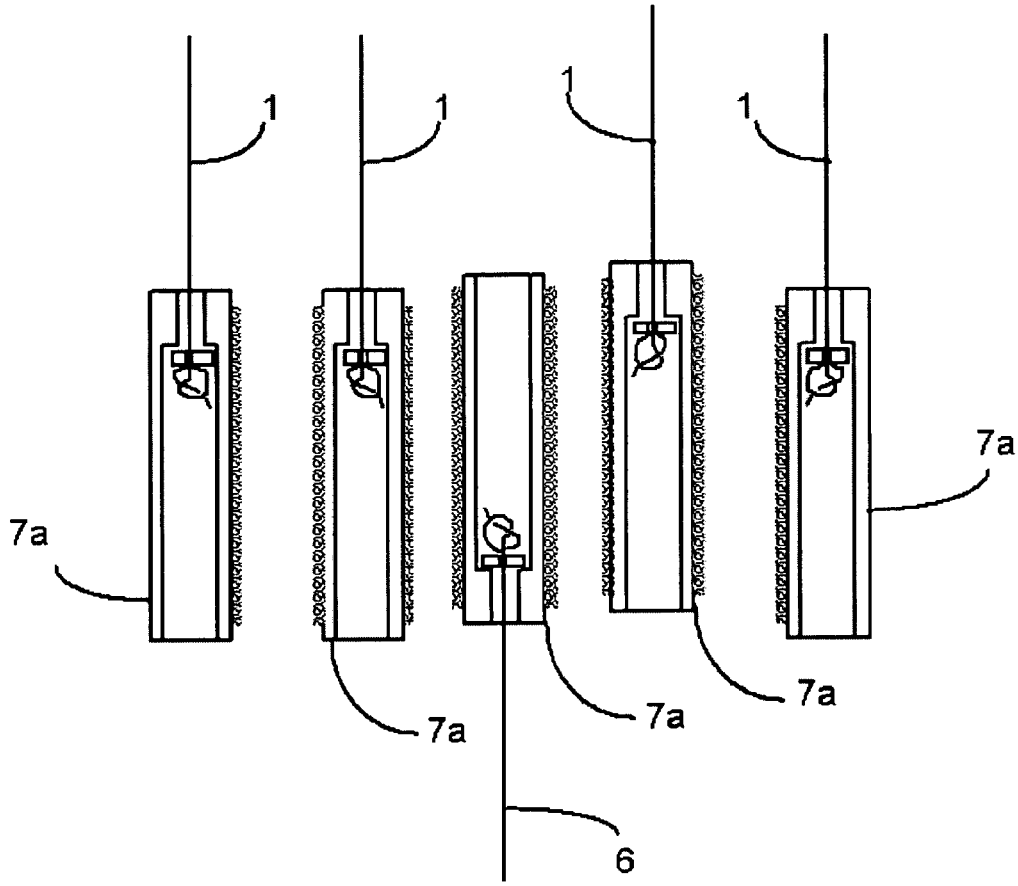
FIG. 5 is a side elevation view of a coupling assembly according to another embodiment of the invention.

Referring to FIGS. 4 and 5, other embodiments of the coupling assembly 7 of the present invention are shown. In the embodiment shown in FIG. 4, the coupling assembly 7 is substantially similar to the coupling assembly shown in FIG. 3 with at least one exception, namely, the middle cordlock member 7*a* is also attached to a lift cord 1. In the embodiment shown in FIG. 5, the coupling assembly is substantially similar to the coupling assembly shown in FIG. 3 with at least one exception, namely, two additional cordlock members 7*a* are added outward of the original cordlock members shown in FIG. 3. It will be appreciated that both odd and even numbered coupling assemblies of any cordlock member count may be handled with additional repetitions of the embodiments shown in FIGS. 4 and 5.

Regardless of the number of lift cords 1 required by a particular shade, the present invention provides a convenient, compact and adjustable way of joining multiple lift cords into a single pull cord and to receive tension therefrom via shearing forces on the joined surfaces, while providing very low separating force if those surfaces are peeled apart, as by a person's hand or neck accidentally entangled between any two cords. Further, no small parts become separated from the coupling member even in such an entanglement event, further avoiding the problem of lost or swallowed components.

As will be appreciated by one skilled in the art, the embodiments shown and described above in FIGS. 2-5 are not limited to the illustrations shown. Variations of the embodiments illustrated in the drawings include, for example: (a) differently-shaped cordlock members 7*a*, perhaps with side openings or other retaining features for the cords; (b) attachment of multiple cords to more than two faces of a central cordlock member or assembling multiple cordlock members in other than a linear-stacked array; (c) replacing the pull cord 6 with a rigid or resilient wand element; (d) providing a decorative, easily separated sheath over the multiple cordlock members in a visually-integrated manner; (e) attaching a pull cord to each cordlock member 7*a*; and (f) using no pull cord and letting the cluster of cordlock members serve as a tassel for the user's grip. None of these examples depart from the features and benefits of the present invention, which include shear-loaded, separable joints between elements on cords as a means for adjusting the functional lengths of the separate cords in a shade, and to equalize their loads, while collating them for convenience in shade actuation. All of these features are satisfied in the present invention without creating a safety hazard of strong loops that may entangle and choke.

Among other features, the components of coupling assembly 7 shown in FIGS. 2-5 are conducive to being easily manufactured from commonly-used materials, such as plastics. The coupling assembly 7 is readily assembled and can be configured with multiples of one or more key components to accommodate different numbers of shade cords. The present invention also enables rapid and revisable equalization of exposed cord lengths, either during or after manufacture and installation, and eliminates one of the most difficult operations in the fabrication of corded shades (i.e., equalizing co-fixed cords). The coupling assembly 7 of the present invention provides reliable, repeatable, and adjustable equalization both during and after initial assembly. Among other benefits, the equalization features of coupling assembly 7 reduce the cost of manufacture, eliminate perceived flaws of uneven hanging once installed, and allow simple owner adjustments to equalization throughout the life of the product to accommodate any wear or stretch in the components. In addition to the benefits noted above, coupling assembly 7 provides enhanced safety against the risk of entanglement injury by allowing very low force separation of cordlock members 7*a* when an object larger than the width of cordlock members 7*a* (such as an arm or child's neck) is placed between adjacent cords, forcing the mating surfaces apart.

Figure 6:
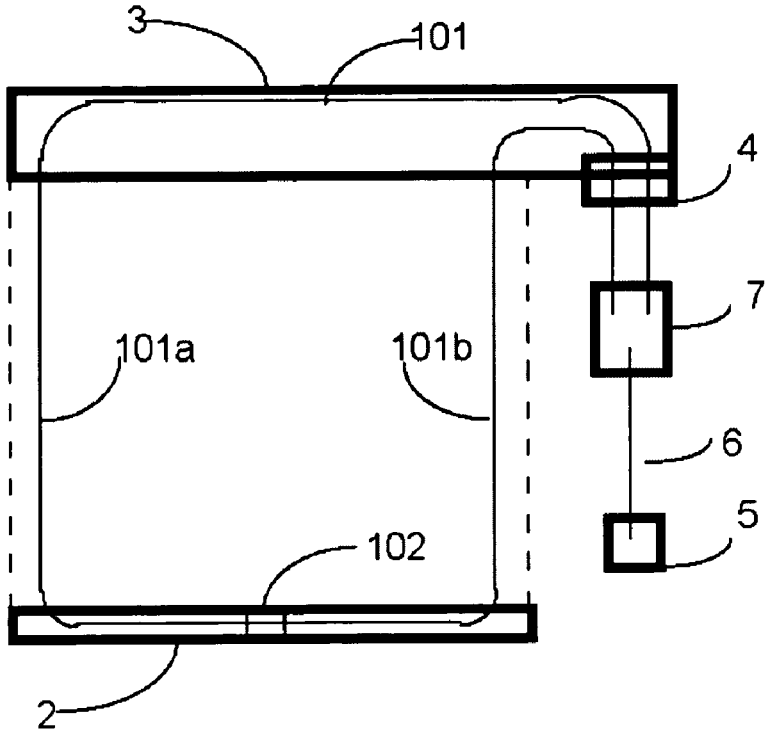
FIG. 6 is a front elevation view of a window covering according to an embodiment of the invention.

Referring to FIG. 6, another embodiment of the present invention is shown. The underlying concept of this embodiment is the unification of the multiple lift cords into a single loop of cord traversing the moving rail of the shade and the single point of operator contact (or attachment of such contact if a secondary pull-cord is used). The unified loop can be gripped locally to define the positional relationship between the operator contact point and the two parts of the loop (either side of the grip point). By varying the grip location on the loop and, accordingly, the relative lengths of the two loop parts, equalization of the shade is effected.

Figure 6A:
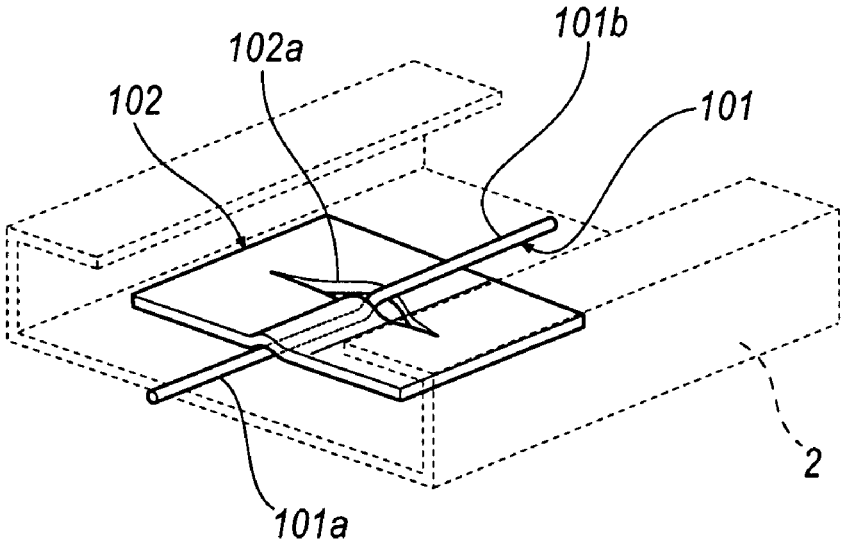
FIG. 6*a* is a perspective view of a cord-gripping member, showing a portion of the bottom rail in phantom.

As shown in FIGS. 6 and 6*a*, a window covering is provided that includes a loop cord 101, including cord portions 101*a* and 101*b*, and a gripping member 102. While the window covering shown in FIG. 6 includes a single loop cord, it will be appreciated that multiple loop cords, nested across the width of shade (all "a" portions to one side and all "b" portions to the other) are also within the scope of the invention. The gripping member 102 may be a discrete device, like a clamp, or a passive device, such as a device that provides frictional resistance to cord passage at a close-fit orifice. In a particular configuration illustrated in FIG. 6*a*, the gripping member 102 is a small membrane (e.g., a square having about ¾ inch sides) of resilient polyester sheeting material, about 5 to 10 thousandths of an inch thick, having a slit 102*a* of predetermined length (e.g., one-half inch long). The cord 101 is passed through slit 102*a*, preferably in a direction perpendicular to the direction of the slit to minimize a tendency of the cord to migrate and jam at an end of the slit. In the disclosed position within the bottom rail, the membrane is preferably oriented in a horizontal plane and secured by pressure-sensitive adhesion to the upwardly-facing inner surface of the bottom wall of bottom rail 2. Alternatively, the membrane could be secured to the underside of the stiffener that is typically secured to the lowermost portion of the shade fabric for retaining the fabric within the bottom rail.

The distortion of the loop cord path by passing through the slit in the resilient membrane provides sufficient frictional resistance to preserve cord-to-bottom rail positioning during normal operation. However, in the event that the bottom rail loses its desired level orientation, this releasable frictional grip allows convenient adjustment or correction of bottom rail orientation by an operator simply pulling downward on the higher end of bottom rail with sufficient force to overcome the gripper's frictional grip on the cord.

Figure 7:
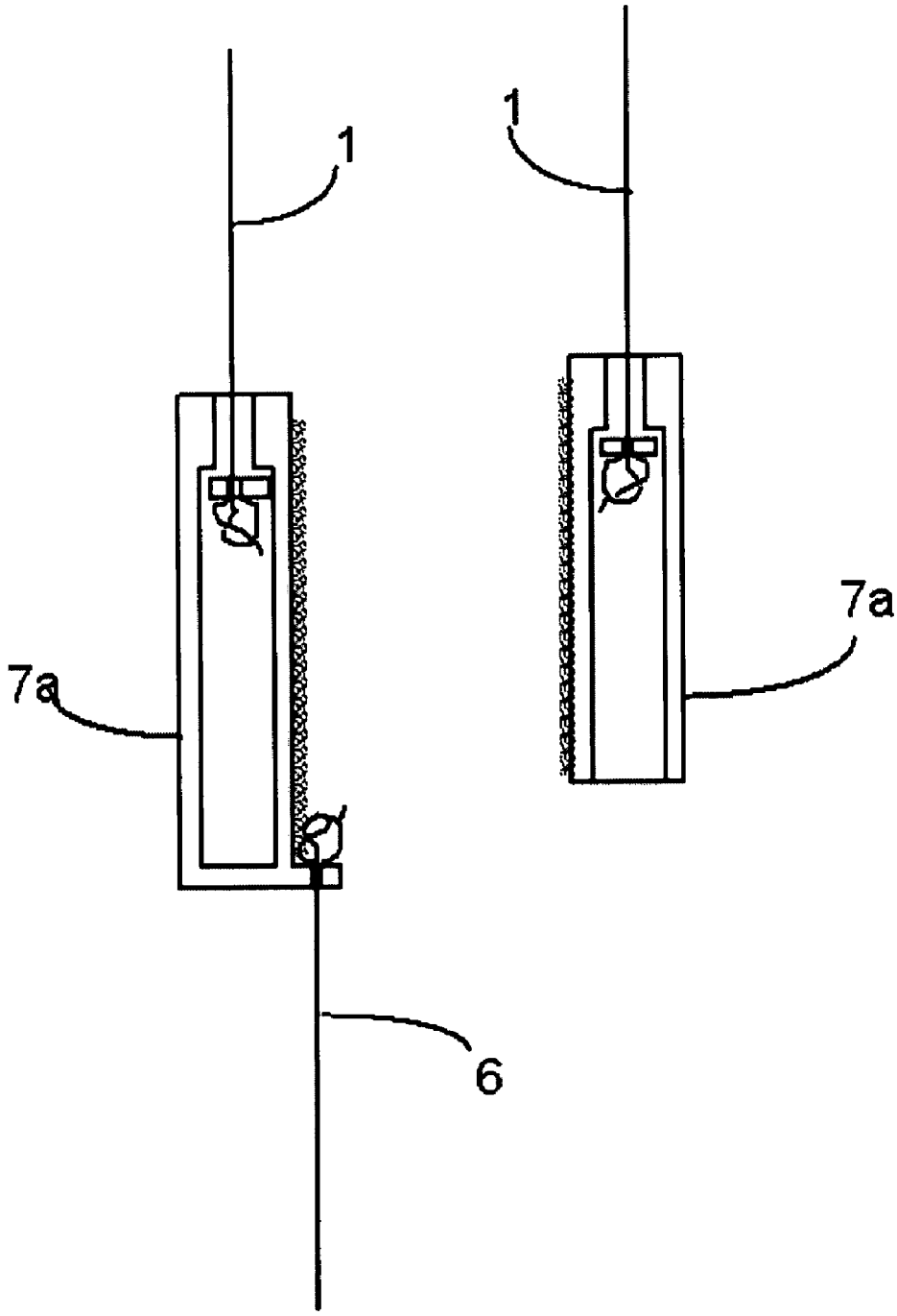
FIG. 7 is a side elevation view of a coupling assembly according to another embodiment of the invention.

The window covering shown in FIG. 6 may also include a coupling assembly similar to the coupling assembly shown in FIGS. 2-5 and describe above. In addition to the coupling members shown in FIGS. 2-5, one such coupling assembly for use with the window covering of FIG. 6, is shown in FIG. 7. In the embodiment shown in FIG. 7, the coupling assembly 7 includes one cordlock member 7*a* secured to each of the two cord ends of loop cord 101. Further, at least one of the cordlock members 7*a* is modified to directly receive and attach a pull cord 6 as shown in FIG. 7. The combination of a single loop cord 101, equalized at the bottom rail 2, with the coupling assembly 7 of the present invention (i.e. one that receives tension therefrom via shearing forces on the joined surfaces, while providing very low separating force if those surfaces are peeled apart, as by a person's hand or neck accidentally entangled between the two cord ends) provides an economical, convenient, and safe solution for most common shades, the weight of which can be handled without additional cords. Further, no small parts become separated even in such an entanglement event, further avoiding the problem of lost or swallowed small parts.

As will be appreciated by those skilled in the art, the embodiments shown in FIGS. 6 and 7 are not limited to the illustrations shown. Some exemplary variants to the embodiments illustrated in the drawings would include, for example: (a) multiple loop cords (nested to allow rail tilting) for four, six or more cord runs in a shade; (b) a single, central cord, affixed to the bottom rail, with a loop cord providing two outer cord runs in a "three-cord" shade; (c) use of the loop-cord in-rail equalizer with separating cord coupling members other than those shown in FIGS. 2-5 and 7; (d) use of the loop-cord in-rail equalizer with other types of actuating systems (including, for example, spooled cords in the head rail, wands or clutched operating loop cords); and (e) locating the gripping member 102 in locations other than the bottom rail 2. None of these examples depart from the features and benefits of the invention, which include a continuous cord through the shade, with its ends together at the operator grip or other actuator, an adjustable positioning between the cord and the bottom rail, and with the further benefit that the adjustment mechanism remains accessible and owner-adjustable after completion of manufacture or installation.

Among other features, the invention shown in FIGS. 6 and 7 is conducive to being easily incorporated into conventional shades and fabrication methods, with any required parts or modifications manufactured from commonly-used materials, such as plastics. It is more readily assembled than conventionally-equalized shades either during or after manufacture and installation. It eliminates one of the most difficult operations in the fabrication of corded shades (equalizing co-fixed cords) and can be configured with multiples of the same key components to accommodate different numbers of shade cords. The invention shown in FIGS. 6 and 7 provides reliable, repeatable, and adjustable equalization both during and after initial assembly. This will reduce cost of manufacture, perceived flaws of uneven hanging once installed, and simple owner adjustments to equalization throughout the life of the product to accommodate any wear or stretch. Further, the window covering shown in FIG. 6, when combined with a separating cord coupling assembly (such as the coupling members shown in FIGS. 2-5 and 7) at the operator's grip point, provides all these assembly benefits in addition to enhanced safety against the risk of entanglement injury by providing very low force separation when an object larger than the block width (such as an arm or child's neck) is placed between adjacent cords, forcing the mating surfaces apart.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A window covering, comprising:

a head rail and a bottom rail;

a shade portion having first and second lateral ends and extending between said head rail and said bottom rail;

a lift cord loop extending through said bottom rail and having first and second cord portions that respectively extend up through said shade portion adjacent said first and second lateral ends and into said head rail and then out of said head rail, such that the respective ends of said first and second cord portions are exposed for manipulation by an operator; and a cord-gripping member connected to said window covering and through which said lift cord loop passes, said gripping member adapted to provide sufficient resistance to preserve cord-to-bottom rail positioning during normal window covering operation, but allowing leveling of a non-level bottom rail when an operator applies a downward force on the higher end of such non-level bottom rail that is sufficient by itself to overcome the resistance of said gripping member.

2. The window covering of claim 1 wherein said cord-gripping member is positioned inside said lower rail.

3. The window covering of claim 1 wherein said cord-gripping member releasably grips said lift cord by a frictional drag force.

4. The window covering of claim 1 wherein said cord gripping member is a thin, resilient membrane having a slit through which said lift cord passes, the edges of said slit being oriented and adapted to yieldably and frictionally grip said lift cord.

5. The window covering of claim 1, further including a coupling member that includes a first cord look member attached to the end of said first cord portion, a second cordlock member attached to the end of said second cord portion, and a shear-loaded, separable joint between said first and second cordlock member, said joint being relatively strong when loaded in shear, but separating relatively easily in peel or tension perpendicular to said joint.

6. The coupling member of claim 5, wherein said separable joint includes a surface modifier on opposing abutting surfaces of each of said cordlock members, said surface modifiers providing a separable joint that grips strongly in shear, but easily separates in peel or tension perpendicular to said surfaces of said cordlock members.

7. A window covering, comprising:

a head rail and a bottom rail;

a shade portion having first and second lateral ends and extending between said head rail and said bottom rail;

a lift cord loop extending through said bottom rail and having first and second cord portions that respectively extend up through said shade portion adjacent said first and second lateral ends end into said head rail and then out of said head rail, such that the respective ends of said first and second cord portions are exposed for manipulation by an operator;

a cord-gripping member connected to said window covering and through which said lift cord loop passes, said gripping member adapted to provide sufficient resistance to preserve cord-to-bottom rail positioning during normal window covering operation, but allowing leveling of a non-level bottom rail when an operator applies a downward force on the higher end of such non-level bottom rail that is sufficient to overcome the resistance of said gripping member; and wherein said cord gripping member is a thin, resilient membrane having a slit through which said lift cord passes, the edges of said slit being oriented and adapted to yieldably and frictionally grip said lift cord.

* * * * *

UNITED STATES PATENT AND TRADEMARK OFFICE

CERTIFICATE OF CORRECTION

PATENT NO. : 7,311,132 B2
APPLICATION NO. : 11/033251
DATED : December 25, 2007
INVENTOR(S) : John A. Corey et al.

It is certified that error appears in the above-identified patent and that said Letters Patent is hereby corrected as shown below:

In Claim:

In Claim 5, line 65, replace “first cord look” with --first cordlock--.

Signed and Sealed this

Tenth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,311,132 B2
APPLICATION NO. : 11/033251
DATED : December 25, 2007
INVENTOR(S) : John A. Corey et al.

It is certified that error appears in the above-identified patent and that said Letters Patent is hereby corrected as shown below:

Column 6

In Claim 5, line 65, replace "first cord look" with --first cordlock--.

This certificate supersedes the Certificate of Correction issued June 10, 2008.

Signed and Sealed this

Fifteenth Day of July, 2008

JON W. DUDAS
*Director of the United States Patent and Trademark Office*